US005423664A

United States Patent [19]

Iizuka et al.

[11] Patent Number: 5,423,664

[45] Date of Patent: Jun. 13, 1995

[54] IRON-BASE ALLOY FOR ROTARY TYPE COMPRESSORS

[75] Inventors: Tadashi Iizuka, Ashikaga; Kazushi Fukuda; Akihiko Ishiyama, both of Tochigi; Hideki Yazawa, Saitama; Shoichi Nakashima, Hitachi; Hideki Nakamura, Yonago, all of Japan

[73] Assignee: Hitachi, Ltd., Tokyo, Japan

[21] Appl. No.: 275,349

[22] Filed: Jul. 15, 1994

[30] Foreign Application Priority Data

Jul. 29, 1993 [JP] Japan ..... 5-187813

[51] Int. Cl.[6] ..... F03C 2/00

[52] U.S. Cl. ..... 418/179; 420/9; 420/13

[58] Field of Search ..... 418/179; 148/321, 612; 420/9, 13

[56] References Cited

U.S. PATENT DOCUMENTS

| | | | |
|---|---|---|---|
| 4,692,305 | 9/1987 | Rangaswawy et al. | 420/436 |
| 5,125,811 | 6/1992 | Amano et al. | 418/179 |
| 5,316,596 | 5/1994 | Kataoka | 148/321 |

FOREIGN PATENT DOCUMENTS

| | | | |
|---|---|---|---|
| 0013005 | 1/1979 | Japan | 418/179 |
| 0043816 | 3/1984 | Japan | 148/612 |
| 1456811 | 11/1976 | United Kingdom | 418/179 |

*Primary Examiner*—Richard A. Bertsch
*Assistant Examiner*—Charles G. Freay
*Attorney, Agent, or Firm*—Antonelli, Terry, Stout & Kraus

[57] ABSTRACT

A roller of a rotary type compressor is made of an iron base alloy essentially consisting of 2.0 to 3.9% carbon, 2.0 to 3.0% Si, 0.3 to 1.0% Mn, up to 0.10% S, more than zero and not more than 0.50% V, 0.3 to 1.0% P, 0.01 to 0.5% Sb, and balance of Fe and incidental impurities. Preferably, the iron base alloy further includes 0.001 to 0.5% B. This roller is suitable when hydrofluorocarbon is used as a refrigerant.

23 Claims, 1 Drawing Sheet

IRON-BASE ALLOY FOR ROTARY TYPE COMPRESSORS

FIELD OF THE INVENTION

The present invention relates to a rotary type compressor having an eccentric roller and a vane, which is applied to a refrigeration cycle in an air conditioner, a refrigerator or the like and, more particularly, to a compressor in which hydrofluorocarbon (hereinafter referred to as HFC) can be suitably used as a refrigerant in place of chlorofluorocarbon (hereinafter referred to as CFC).

TECHNICAL BACKGROUND

In a rotary type compressor, a vane is generally pressed against the outer peripheral surface of a roller by bias means of a hydraulic pressure, a spring or the like so as to maintain sealing tightness between these two members, thereby obtaining a high discharge pressure. The roller rotates eccentrically while it is constantly in contact with the vane. In order to increase a gas compression ratio in accordance with a demand for a higher performance of the compressor, a rotational speed of the roller must be increased. When the rotational speed of the roller is increased, wear of contact portions of the roller and the vane which are in constant with each other is remarkably increased. The roller rotates while it is in contact with the vane at its outer peripheral surface and with a cylinder wall at its both opposite end surfaces. Therefore, the roller is required to have properties not only of wear resistance per se but also of causing the vane and the cylinder which are mating sliding contact members not to wear.

Conventionally, such type of roller is made of cast iron by continuous casting, eutectic graphite cast iron, or Cu—Cr—system, Cu—Mo—system or Mo—Ni—Cr—system low alloy cast iron. Cast iron by continuous casting in particular is known to have a finer structure of the surface layer and a more excellent wear resistance property than cast iron produced by other casting methods. This type of material is disclosed in, for example, JP-B2-60-1943.

At present, the refrigerant used for compressors is CFC. As well known, when CFC is released into the atmosphere, it diffuses up to the stratosphere and is decomposed by irradiation of ultraviolet rays, thereby discharging chlorine which destroys the ozone layer. Such destruction of the ozone layer is globally considered as an environmental problem. Projects for totally abolishing use of CFC until the year 2000 have been formed, and development of an alternative refrigerant has progressed in each country.

As an alternative refrigerant, HFC containing no chlorine is the most promising. For example, 1,1,1,2 tetrafluoroethane ($CH_2FCF_3$) known as R-134a may be raised. Use of such kind of refrigerant fluorocarbon involves the following problems when it is compared with use of the conventional CFC although it does not so much adversely affect the environment.

a) A lubricative property of the refrigerant is inferior.
b) The compression ratio must be increased, and consequently, the load acting on the roller and the vane becomes greater.
c) A hygroscopic property of the refrigerant is larger.
d) A lubricative property of a lubricant used with the refrigerant is inferior.

e) A hygroscopic property of the lubricant is larger.
f) Wear of the sliding contact members such as the cylinder, the roller and the vane increases.

Especially, the problem of wear mentioned in Item f is important. Since the conventional CFC contains chlorine, it forms stable protective film (chloride) over the surfaces of the sliding contact members so as to provide the sliding contact surfaces with good wear resistance properties. On the other hand, HFC of an alternative fluorocarbon for overcoming the environmental problem contains no chlorine. Therefore, unlike CFC, such an advantageous effect of improving the wear resistance property can not be expected, and HFC involves a problem in practical use. Consequently, if the alternative fluorocarbon is used without changing kinds of the roller material, the roller wears heavily due to sliding contact with the vane, and scoring also occurs between the roller and the vane resulting in that durability as a practical compressor can not be obtained, although cast iron by continuous casting has excellent wear resistance properties.

SUMMARY OF THE INVENTION

Thus, it is a primary objective of the present invention to solve the problems of material properties of a roller when HFC is used as a refrigerant of a rotary type compressor. Another objective of the invention is to provide a compressor in which conformability of a roller with a vane is so high that wear of the sliding contact surfaces of these two members can be decreased, and that the compressor can accordingly endure long-term operation.

The following compressor is provided under the above objectives.

A compressor comprising a cylinder having a suction port and a discharge port, a roller which eccentrically rotates in the cylinder, and a vane which is constantly enforced to be in press contact with the roller by biasing force of bias means, in which a refrigerant is taken into the cylinder through the suction port is compressed-by the roller and the vane, and discharged out of the cylinder through the discharge port, wherein the roller is made of an iron base alloy essentially consisting of, by weight, 2.0 to 3.9% of total carbon, 2.0 to 3.0% Si, 0.3 to 1.0% Mn, up to 0.10% S (sulfur), more than zero and not more than 0.50% V, 0.3 to 1.0% P (phosphorus), 0.01 to 0.5% Sb, and balance of Fe and incidental impurities.

According to another aspect of the invention, there is provided a compressor wherein a roller is formed of an iron base alloy essentially consisting of, by weight, 2.0 to 3.9 % of total carbon, 2.0 to 3.0 % Si, 0.3 to 1.0% Mn, up to 0.10% S, more than zero and not more than 0.50% V, 0.3 to 1.0% P, 0.01 to 0.5% Sb, 0.001 to 0.5% B (boron), and balance of Fe and incidental impurities.

Preferably, amounts of P, Sb and B in each of the iron base alloys which form the rollers are 0.4 to 0.6%, 0.05 to 0.12% and 0.07 to 0.13%, respectively. Also, each of the iron base alloys which form the rollers can further contain, by weight, at least one of 0.05 to 1.0% Cu, 0.05 to 1.0% Mo and 0.05 to 1.0% Cr.

As a preferable vane material which has an excellent conformability with the roller material and can decrease wear caused due to sliding contact, the following materials can be suitably used: 1) an iron base alloy essentially consisting of, by weight, 1.0 2.5% of total carbon, more than zero and not more than 1.5% Si, more than zero and not more than 1.0% Mn, 3.0 to 6.0% Cr, at least one of more than zero and not more than 20.0% W and more than zero and not more than 12.0% Mo in such a range as to satisfy the formula $15.0\% \leqq W+2Mo \leqq 28.0\%$, 3.5 to 10% at least one of V and Nb, 1.0 to 15.0% at least one of Co and Ni, and balance of Fe and incidental impurities, 2) an aluminum material reinforced with carbon, and 3) an aluminum alloy material reinforced with carbon, can be suitably used.

The roller is preferably provided in the form of a hollow cylindrical member obtained by removing an inside portion of a round bar made of one of the foregoing iron base alloys manufactured by continuous casting. Normally, the outer peripheral surface of the roller is subjected to a heat treatment to provide wear resistance property to the roller. A preferable roller material according to the invention comprises an outer peripheral surface layer being subjected to heat treatments of heating 880° to 940° C. (preferably, 920° C.±5° C.) for 1.0 to 2.5 hours followed by oil quenching, and of subsequent tempering in a non-oxidizing environment at 180 ® to 250° C. (preferably, 230° C.±5° C.) for 1.0 to 2.5 hours.

The refrigerant used in the compressor of the invention is HFC containing no chlorine such as 1,1,1,2 tetrafluoroethane ($CH_2FCF_3$) known as R-134a. As a lubricant, polyole ester oil which has a good conformability with HFC can be suggested as one example.

DETAILED DESCRIPTION OF THE INVENTION

1. Composition of Roller Material

Figure 1:
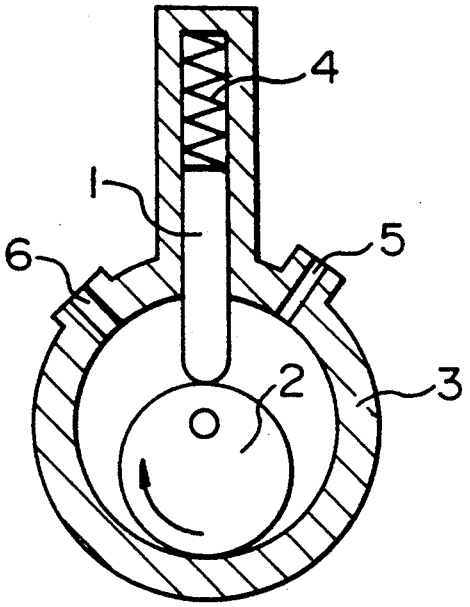
FIG. 1 is a diagram schematically showing an essential portion of a rotary type compressor according to the present invention.

Carbon: When the total carbon content in the roller material is less than 2.0%, carbide required for ensuring wear resistance property of the roller is not formed. When it exceeds 3.9%, the roller material becomes unfavorably brittle. Therefore, the total carbon content is preferably 2.0 to 3.9%.

Si: Si improves the quality of iron alloys as a deoxidizing element. When the Si content exceeds 3.0%, the roller material becomes unfavorably brittle. When the Si content is less than 2.0%, the castability is deteriorated. Therefore, the preferred Si content is 2.0 to 3.0%.

Mn: Mn also improves the quality of iron alloys as a deoxidizing element. When the Mn content is too much, an amount of shrinkage of the cast iron alloy is large. When the Mn content is too small, it is difficult to prevent the material to become brittle since sulfur is fully fixed in the form of MnS, and also, pearlite is not so stable. Therefore, the preferred Mn content is 0.3 to 1.0%.

S: When the sulfur content is too much, the material becomes brittle, and consequently, it is limited to up to 0.10%.

V: Vanadium combines with carbon so as to improve wear resistance property. However, because more than 0.50% vanadium is unnecessary, the vanadium content is limited to form more than zero to not more than 0.50%.

P, Sb and B: P (Phosphorus), Sb and B (boron) are important alloying elements in the invention. More specifically, phosphorus forms steadite (phosphorus eutectic compound, i.e., eutectic compound of Fe3P and austenite containing phosphorus), which combines with carbide in the alloy material to form a complex compound so as to stabilize the carbide, thus contributing to improvement of the wear resistance property. Desirably, the complex compound is finely and uniformly distributed in the matrix. When the phosphorus content is too much, the material becomes brittle, and when it is too small, an effect of fully improving the wear resistance property can not be obtained. Therefore, preferably, the phosphorus content is 0.3 to 1.0%, more preferably 0.4 to 0.6%.

Similarly, Sb contributes to improvement of the wear resistance property. When the Sb content is too much, Sb crystalizes at crystal grain boundaries, thereby making the material brittle and deteriorating the strength. Consequently, it is important to add a proper amount of Sb to the material and dissolve it into the matrix. When the Sb content is too small, an effect of fully improving the wear resistance property can not be obtained. Therefore, preferably, the Sb content is 0.01 to 0.5%, more preferably, it is 0.05 to 0.12%.

Also, boron is effective in improving the wear resistance property. Especially, the effect is remarkably observed in the quenching process during heat treatment. When the boron content is too high, the material becomes brittle, and when it is too low, a sufficient effect of improving the wear resistance property can not be produced. Therefore, preferably, the boron content is 0.001 to 0.5%, more preferably 0.07 to 0.13%.

Conditions of the heat treatment of the roller material are important to improve the wear resistance property. A heat treatment layer is formed along the peripheral surface of the roller by the heat treatments of heating at 880° to 940° C. (preferably, at 920°±5° C.) for 1.0 to 2.5 hours followed by oil quenching and of subsequent tempering in a non-oxidizing environment at 180° to 250° C. (preferably, at 230°±5° C.) for 1.0 to 2.5 hours. A vegetable oil is generally used for oil quenching. As the non-oxidizing environment for tempering treatment, a neutral environment such as nitrogen gas or a reducing gas environment such as hydrogen gas is employed. Taking safety and economy into account, tempering treatment is normally carried out in a nitrogen gas environment.

Cu, Mo and Cr: Further, as a special alloy component, at least one of 0.05 to 1.0% Cu, 0.05 to 1.0% Mo and 0.05 to 1.0% Cr can be added to the cast iron alloy. Both Cu and Mo improve the wear resistance property and are effective in the heat treatment (quenching). Cr forms carbide and improves the wear resistance property. However, when any one of the elements is added excessively, it makes the material brittle and deteriorates the strength, and when the additive amount is too small, an effect of fully improving the wear resistance property can not be obtained. Therefore, the foregoing preferable ranges are determined.

2. Composition of Vane Material

In the compressor, conformability of the roller material with the vane is an important factor. For the vane, a material which can decrease wear in sliding contact between the two members is desirable. In the present invention, as described before, the following materials are desirable to the vane: 1) an alloy essentially consisting of, by weight, 1.0 to 2.5% of total carbon more than zero to not more than 1.5% Si, more than zero to not more than 1.0% Mn, 3.0 to 6.0% Cr, at least one of more than zero and not more than 20.0% W and more than zero and not more than 12.0% Mo in such a range as to satisfy the formula $15.0 \leqq W+2Mo \leqq 28.0\%$, 3.5 to 10.0% at least one of V and Nb, 1.0 to 15.0% at least one of Co and Ni, and balance of Fe and incidental impurities, 2) an aluminum material reinforced with carbon, and 3) an aluminum alloy material reinforced with carbon.

Carbon combines with W, Mo, V or the like in the former vane material so as to form hard carbides, thus enhancing the wear resistance property and lessening scoring with the roller material. When the carbon content is less than 1.0%, an effect of fully improving the wear resistance property can not be obtained, and when it is too much, the material becomes brittle. Therefore, preferably, the carbon content is 1.0 to 2.5%. Similarly, Si makes the material brittle when it is added excessively. Consequently, the Si content is more than zero and not more than 1.5%. Also, Mn makes the material brittle when it is added excessively, so that the Mn content is more than zero and not more than 1.0%. Cr forms carbides and produces an effect of enhancing the wear resistance property. When an additive amount of Cr is small, the effect is small, and when it is too much, the material becomes brittle. Therefore, the Cr content is 3.0 to 6.0%. W and Mo combine with carbon, thus enhancing the wear resistance property and the scoring resistance property.

V and Nb combine with carbon and form MC-type carbides, thereby decreasing wear of the vane and also preventing wear of the roller. When additive amounts of V and Nb are small, the effect is small, and when they are too much, the material becomes brittle. Therefore, the amount of at least one of them is limited to 3.5 to 10.0%.

Co and Ni are effective in improving the corrosion resistance and wear resistance properties. When additive amounts of Co and Ni are small, the effect is small, and when they are too much, the material becomes brittle. Therefore, the amount of at least one of them is limited to 1.0 to 15.0%.

EXAMPLE 1

Rollers and vanes were manufactured in substantially the same manner as actual rotary type compressors, and the parts were assembled into model compressors except a refrigerant. Then, wearing tests of the rollers were conducted. The results will now be described.

(1) Manufacture of Roller Samples for Wearing Tests

Four kinds of roller materials shown in Table 1 were manufactured by the known continuous casting method. Round bars of the cast iron thus obtained were cut to have a roller length, and a central portion of each of the cut bars was removed by machining, thereby obtaining hollow rollers. The rollers were subjected to heat treatment and provided for wear tests with vanes. The heat treatment was oil quenching into a vegetable oil (at a quenching temperature of 920° C. for two hours) and tempering treatment in nitrogen gas (at 230° C. for two hours).

Among the samples, a commercial product (a comparative example 1) is a typical cast iron by continuous casting which has conventionally been used for rollers. GS-1 (a comparative example 2) has a similar composition to invention examples 1 and 2, but the phosphorus content is lower than those of the invention examples and out of the composition range of the invention. It should be noted that balance of each of the alloy compositions shown in Table 1 consists of Fe and a trace amount of unavoidable impurities.

TABLE 1

| | Composition of Roller Material (Unit: Weight %) | | | | | | | | | |
|---|---|---|---|---|---|---|---|---|---|---|
| | Composition | | | | | | | | | |
| Sample Number | T · C | Si | Mn | P | Cu | Mo | Cr | Sb | B | Hardness (HRC) |
| Commercial Product (Comparative Example 1) | 3.5 | 2.7 | 0.7 | 0.1 | — | 0.1 | 0.1 | | — | 51 |
| GS-1 (Comparative Example 2) | 3.5 | 2.6 | 0.6 | 0.1 | 0.6 | 0.3 | 0.1 | 0.08 | — | 52 |
| GS-2 (Invention Example 1) | 3.5 | 2.6 | 0.6 | 0.5 | 0.6 | 0.3 | 0.1 | 0.08 | — | 52 |
| GS-3 (Invention Example 2) | 3.5 | 2.6 | 0.6 | 0.5 | 0.6 | 0.3 | 0.1 | 0.08 | 0.08 | 52 |

*T · C: Total carbon (2) Manufacture of Vanes

Sliding contact properties of the rollers are closely concerned with material properties of vanes used with the rollers. Therefore, in addition to commercial Al alloy reinforced with carbon and JIS SKH51 (high speed tool steel), vanes 1 and 2 of invention example materials which have especially excellent conformabilities with rollers according to the invention were manufactured. The compositions of the vane materials except the Al alloy reinforced with carbon are shown in Table 2.

TABLE 2

| | Composition of Vane Material (Unit: Weight %) | | | | | | | | | | |
|---|---|---|---|---|---|---|---|---|---|---|---|
| | Composition | | | | | | | | | | |
| Sample Number | T · C | Si | Mn | P | S | Cr | W | Mo | V | Co | Hardness (HRC) |
| Commercial Product) JIS SKH51 | 0.89 | 0.23 | 0.28 | 0.02 | 0.001 | 3.87 | 6.06 | 4.95 | 1.92 | — | 65.3 |
| Invention Example 1 | 1.58 | 0.32 | 0.30 | 0.016 | 0.002 | 4.15 | 7.88 | 6.07 | 4.00 | 7.75 | 66.7 |

TABLE 2-continued

| Sample Number | Composition of Vane Material (Unit: Weight %) Composition T · C | Si | Mn | P | S | Cr | W | Mo | V | Co | Hardness (HRC) |
|---|---|---|---|---|---|---|---|---|---|---|---|
| Invention Example 2 | 2.14 | 0.32 | 0.32 | 0.019 | 0.006 | 4.21 | 11.49 | 2.53 | 6.96 | 7.92 | 66.5 |

*T · C: Total carbon (3) Results of Wear Test of the Rollers

The model compressors including no refrigerant conducted. Polyole ester oil of VG32 was used as were assembled, and wear tests of the rollers were refrigerating machine oil serving as a lubricant. The total acid value was 0.17 mg KOH/g to promote corrosion wear because the tests were performed under severe conditions. A temperature of the compressor was 130° C. in accordance with actual operating conditions, and a sliding speed of the roller was 5.7 m/sec. The results are shown in Table 3.

wear test data of Table 3. Particularly, in the case of a combination of the invention example 2 of roller (GS-3) and the vane 2, the wear amount is remarkably small, and the friction coefficient is significantly low. From the compositions of roller materials shown in Table 1 and the results shown in Table 3, it is presumed that P, Sb and B of appropriate amounts function effectively for producing favorable properties.

EXAMPLE 2

As an example of HFC which is an alternative fluoro-

TABLE 3

| Roller Material | Evaluation Item | Roller Material/Vane Material Wear Test — Vane Material: Invention Example Vane 1 Wearing Test Data | Invention Example Vane 1 Judgement | Invention Example Vane 2 Wearing Test Data | Invention Example Vane 2 Judgement | Invention Example A1 Material Reinforced with Carbon Wearing Test Data | Invention Example A1 Material Reinforced with Carbon Judgement | JIS SKH51 Wearing Test Data | JIS SKH51 Judgement |
|---|---|---|---|---|---|---|---|---|---|
| Commercial Product (Cast Iron by Continuous Casting) Example 1) | Wear Loss | 0.04/2.55 | X | 0.04/4.09 | X | 0.15/0.34 | X | 0.3/0.2 | X |
| | Max. specific surface pressure without scoring | 62.5 | | 62.5 | | 75 or more | | 62.5 | |
| | Friction Coefficient | 0.040 | | 0.049 | | 0.12 | | 0.08 | |
| GS-1 (Comparative Example 2) | Wear Loss | 0.05/0.081 | Δ | 0.04/2.70 | X | | | | |
| | Max. specific surface pressure without scoring | 75 or more | | 25 | | | | | |
| | Friction Coefficient | 0.045 | | 0.038 | | | | | |
| GS-2 (Invention Example Roller 1) | Wear Loss | 0.02/0.08 | ○ | 0.008/0.08 | ○ | 0.3/0.15 | ○ | 0.07/0.08 | ○ |
| | Max. specific surface pressure without scoring | 75 or more | | 75 or more | | 75 or more | | 75 or more | |
| | Friction Coefficient | 0.034 | | 0.033 | | 0.15 | | 0.050 | |
| GS-3 (Invention Example Roller 2) | Wear Loss | 0.04/0.08 | ○ | 0.008/0.08 | ○ | 0.25/0.08 | ○ | 0.06/0 | ○ |
| | Max. specific surface pressure without scoring | 75 or more | | 75 or more | | 75 or more | | 75 or more | |
| | Friction Coefficient | 0.037 | | 0.012 | | 0.12 | | 0.052 | |

*1. When the total acid value of the refrigerating machine oil is 0.17 (mg KOH/g), errosion is promoted. Temperature: 130° C. Sliding contact speed: 5.7 (m/sec)

*2. Unit: Wear loss "Vane material/Roller material" ($mm^3$), Max. specific surface pressure without scoring ($kg/cm^2$)

A judgement result mark ○ indicates an example which exhibited excellent sliding contact properties, Δ indicates an example in which a wear amount of the roller was favorably small but conformability of the roller with the vane was inferior so that wear of the vane was too large to ignore, and x indicates a comparative example in which a wear amount of the roller was so large that the objectives of the invention could not be achieved.

It can be understood from the foregoing results that the invention examples of rollers are superior in respect of any of the properties, as obviously seen from the carbon, 1,1,1,2 tetrafluoroethane ($CH_2FCF_3$) called R-134a was used for a refrigerant, and performance tests were carried out with actual rotary type compressors. The results will now be described.

FIG. 1 is a diagram schematically showing an essential portion of a rotary type compressor in cross section. A vane plate 1 is constantly enforced to be in contact with the peripheral surface of a roller 2 by a bias spring 4. In response to eccentric rotation of the roller 2, the volume of a space defined by the roller 2 and a cylinder 3 changes to compress gas (refrigerant). Reference numeral 5 denotes a suction port of the refrigerant, and 6 a discharge port from which the compressed refrigerant is discharged to the refrigeration cycle.

In a wearing test of the rotary type compressor, the compressor was assembled in an actual refrigeration cycle, polyole ester having a viscosity of VG 32 was used as a lubricant, and wear conditions of the roller 2 and the vane plate 1 after continuous operation at a rotational speed of 3000/rpm for 90 days were measured. The results are shown in Table 4.

TABLE 4

| | Test Results of Compressors | | |
|---|---|---|---|
| | Vane | | |
| Roller | Invention Example Vane 2 Wearing Test Data (Vane/Roller) | Invention Example A1 Material Reinforced with Carbon Wearing Test Data (Vane/Roller) | JIS SKH51 Wearing Test Data (Vane/Roller) |
| Commercial Cast Iron by Continuous Casting (Comparative Example) | 3.0/15 | 25/10 | 100/100 |
| GS-3 (Invention Example 2) | 0.5/7.5 | 20/7.5 | 5/10 |

It should be noted that data of wear tests shown in Table 4 are relative values when a wear amount of a commercial roller made of cast iron by continuous casting and a wear amount of a vane (high speed tool steel JIS SKH51 obtained by casting) in a conventional compressor as a comparative example were each set to be 100.

As obviously understood from Table 4, wear amounts of rollers in the compressors according to the invention are by far smaller than those of the conventional examples, and the rollers of the invention examples have excellent properties. Further, amounts of wear of the associated vanes are small, which expresses the fact that sliding-contact conformability of the rollers with the vanes is excellent.

As will be apparent from the above, the foregoing objectives can be achieved by the present invention. More specifically, there can be realized a compressor which will not be deteriorated in performance even if an alternative fluorocarbon HFC is used for a refrigerant, and which includes a fully practicable roller.

What is claimed is:

1. A compressor comprising a cylinder having a suction port and a discharge port, a roller which eccentrically rotates in the cylinder, and a vane which is constantly enforced to be in contact with the roller by biasing force of bias means, in which a refrigerant intaken into the cylinder through the suction port is compressed by the roller and the vane, and discharged out of the cylinder through the discharge port, wherein said roller is made of an iron base alloy essentially consisting of, by weight, 2.0 to 3.9% of total carbon, 2.0 to 3.0% Si, 0.3 to 1.0% Mn, up to 0.10% S, more than zero and not more than 0.50% V, 0.3 to 1.0% P, 0.01 to 0.5% Sb, and balance of Fe and incidental impurities.

2. A compressor according to claim 1, wherein the iron base alloy which forms said roller further includes, by weight, at least one of 0.05 to 1.0% Cu, 0.05 to 1.0% Mo and 0.05 to 1.0% Cr.

3. A compressor according to either of claims 1 and 2, wherein said roller is a hollow cylindrical member obtained by removing an inside core portion of a round bar manufactured by continuous casting.

4. A compressor according to claim 1, wherein said vane is made of an iron base alloy essentially consisting of, by weight, 1.0 to 2.5% of total carbon, more than zero and not more than 1.5% Si, more than zero and not more than 1.0% Mn, 3.0 to 6.0% Cr, at least one of more than zero and not more than 20.0% W and more than zero and not more than 12.0% Mo in such a range as to satisfy the formula $15.0\% \leqq W+2Mo \leqq 28.0\%$, 3.5 to 10% at least one of V and Nb, 1.0 to 15.0% at least one of Co and Ni, and balance of Fe and incidental impurities.

5. A compressor according to claim 1, wherein said vane is formed either of an aluminum material reinforced with carbon or of an aluminum alloy material reinforced with carbon.

6. A compressor according to claim 1, wherein amounts of P, Sb and B in the iron base alloy which forms said roller are 0.4 to 0.6%, 0.05 to 0.12% and 0.07 to 0.13%, respectively.

7. A compressor according to claim 1, wherein said refrigerant is hydrofluorocarbon.

8. A compressor according to claim 1, wherein a lubricant used with said refrigerant is ester oil.

9. A compressor comprising a cylinder having a suction port and a discharge port, a roller which eccentrically rotates in the cylinder, and a vane which is constantly enforced to be in contact with the roller by biasing force of bias means, in which a refrigerant intaken into the cylinder through the suction port is compressed by the roller and the vane, and discharged out of the cylinder through the discharge port, wherein said roller is made of an iron base alloy essentially consisting of, by weight, 2.0 to 3.9% total carbon, 2.0 to 3.0% Si, 0.3 to 1.0% Mn, up to 0.10% S, more than zero and not more than 0.50% V, 0.3 to 1.0% P, 0.01 to 0.5% Sb, 0.001 to 0.5% B, and balance of Fe and incidental impurities.

10. A compressor according to claim 9, wherein the iron base alloy which forms said roller further includes, by weight, at least one of 0.05 to 1.0% Cu, 0.05 to 1.0% Mo and 0.05 to 1.0% Cr.

11. A compressor according to either of claims 7 and 8, wherein said roller is a hollow cylindrical member obtained by removing an inside core portion of a round bar manufactured by continuous casting.

12. A compressor according to claim 9, wherein said vane is made of an iron base alloy essentially consisting of, by weight, 1.0 to 2.5% of total carbon, more than zero and not more than 1.5% Si, more than zero and not more than 1.0% Mn, 3.0 to 6.0% Cr, at least one of more than zero and not more than 20.0% W and more than zero and not more than 12.0% Mo in such a range as to satisfy the formula $15.0\% \leqq W+2Mo \leqq 28.0\%$, 3.5 to 10% at least one of V and Nb, 1.0 to 15.0% at least one of Co and Ni, and balance of Fe and incidental impurities.

13. A compressor according to claim 9, wherein said vane is made either of an aluminum material reinforced with carbon or of an aluminum alloy material reinforced with carbon.

14. A compressor according to claim 9, wherein amounts of P, Sb and B in the iron base alloy which forms said roller are 0.4 to 0.6%, 0.05 to 0.12% and 0.07 to 0.13%, respectively.

15. A compressor according to claim 9, wherein said refrigerant is hydrofluorocarbon.

16. A compressor according to claim 9, wherein a lubricant used with said refrigerant is ester oil.

17. A roller in a compressor comprising a cylinder having a suction port and a discharge port, the roller which eccentrically rotates in the cylinder, and a vane which is constantly enforced to be in contact with the roller by biasing force of bias means, in which a refrigerant intaken into the cylinder through the suction port is compressed by the roller and the vane, and discharged out of the cylinder through the discharge port, said roller being made of an iron base alloy essentially consisting of, by weight, 2.0 to 3.9% of total carbon, 2.0 to 3.0% Si, 0.3 to 1.0% Mn, up to 0.10% S, more than zero and not more than 0.50% V, 0.3 to 1.0% P, 0.01 to 0.5% Sb, and balance of Fe and incidental impurities.

18. A roller according to claim 1, wherein an outer peripheral surface layer of said roller is subjected to heat treatments of heating at 880° to 940° C. for 1.0 to 2.5 hours followed by oil quenching, and of tempering in a non-oxidizing environment at 180° to 250° C. for 1.0 to 2.5 hours.

19. A roller according to claim 18, wherein said oil quenching temperature is 920° C.±5° C., and said tempering temperature is 230° C.±5° C.

20. A roller in a compressor comprising a cylinder having a suction port and a discharge port, the roller which eccentrically rotates in the cylinder, and a vane which is constantly enforced to be in contact with the roller by biasing force of bias means, in which a refrigerant intaken into the cylinder through the suction port is compressed by the roller and the vane, and discharged out of the cylinder through the discharge port, said roller being made of an iron base alloy essentially consisting of, by weight, 2.0 to 3.9% of total carbon, 2.0 to 3.0% Si, 0.3 to 1.0% Mn, up to 0.10% S, more than zero and not more than 0.50% V, 0.3 to 1.0% P, 0.01 to 0.5% Sb, 0.001 to 0.5% B, and balance of Fe and incidental impurities.

21. A roller according to claim 20, wherein an outer peripheral surface layer of said roller is subjected to heat treatments of heating at 880° to 940° C. for 1.0 to 2.5 hours followed by oil quenching, and of tempering in a non-oxidizing environment at 180° to 250° C. for 1.0 to 2.5 hours.

22. A roller according to claim 21 wherein said oil quenching temperature is 920° C.±5° C., and said tempering temperature is 230° C.±5° C.

23. A vane in a compressor comprising a cylinder having a suction port and a discharge port, a roller which eccentrically rotates in the cylinder, and the vane which is constantly enforced to be in contact with the roller by biasing force of bias means, in which a refrigerant intaken into the cylinder through the suction port is compressed by the roller and the vane, and discharged out of the cylinder through the discharge port, said vane being made of an iron base alloy essentially consisting of, by weight, 1.0 to 2.5% of total carbon, more than zero and not more than 1.5% Si, more than zero and not more than 1.0% Mn, 3.0 to 6.0% Cr, at least one of more than zero and not more than 20.0% W and more than zero and not more than 12.0% Mo in such a range as to satisfy the formula $15.0\% \leqq W+2Mo \leqq 28.0\%$, 3.5 to 10% at least one of V and Nb, 1.0 to 15.0% at least one of Co and Ni, and balance of Fe and incidental impurities.

* * * * *